US005400832A

United States Patent [19]

Kitamura

[11] Patent Number: 5,400,832

[45] Date of Patent: Mar. 28, 1995

[54] METHOD FOR MANUFACTURE OF EXTRA-BROAD WOVEN FABRICS

[76] Inventor: Atsushi Kitamura, 30, Izumi-Hommachi 5-chome, Kanazawa-shi Ishikawa 921, Japan

[21] Appl. No.: 125,138

[22] Filed: Sep. 23, 1993

Related U.S. Application Data

[63] Continuation of Ser. No. 789,195, Nov. 8, 1991, abandoned.

[30] Foreign Application Priority Data

Nov. 10, 1990 [JP] Japan ..... 2-305228

[51] Int. Cl.[6] ..... D03D 19/00; D03D 3/00

[52] U.S. Cl. ..... 139/55.1; 139/384 R; 139/335

[58] Field of Search ..... 139/384 R, 387 R, 387 A, 139/388, 389, 390, 408, 409, 410, 55.1, 35, 335

[56] References Cited

U.S. PATENT DOCUMENTS 697,390 4/1902 Beck ..... 139/387 R
914,429 3/1909 Kunzli ..... 139/388
1,062,143 5/1913 Cardot ..... 139/387 R
3,090,406 5/1963 Koppelman et al. ..... 139/409 X
4,007,763 2/1977 Sellers et al. ..... 139/387 A X

FOREIGN PATENT DOCUMENTS 61-34246 2/1986 Japan .

*Primary Examiner*—Andrew M. Falik
*Attorney, Agent, or Firm*—Amstrong, Westerman, Hattori, McLeland & Naughton

[57] ABSTRACT

A method of manufacturing an integral extra-broad woven fabric without piecing together a plurality of unit fabrics. The method includes disposing a warp yarn as divided into a first group warp yarn, a second group warp yarn . . . an ith group warp yarn . . . and an nth group warp yarn across the width of a weaving loom, inserting a weft in a zigzag fashion turning back at each loom end for each group in succession from the first group warp yarn to the nth group warp yarn and, then, in the reverse order from the nth group warp yarn to the first group warp yarn to complete one cycle of weft insertion and repeating the same cycle again.

1 Claim, 5 Drawing Sheets

METHOD FOR MANUFACTURE OF EXTRA-BROAD WOVEN FABRICS

This application is a continuation of application Ser. No. 07/789,195, filed Nov. 8, 1991, abandoned.

FIELD OF THE INVENTION

The present invention relates to a method of manufacturing an extra-broad woven fabric suitable for such applications as cover sheeting for cliffs, river work, earth filling, building and construction, seating for outdoor events and so on.

BACKGROUND OF THE INVENTION

Brief Description of the Prior Art

Fabrics having unusually large areas are required for certain purposes, e.g. covering precipitous hillsides for prevention of an avalanche of earth and rocks, covering for shore protection work or preparatory work for river beds or banks, bottom sheeting for earth filling work, covering for protection against falling objects, and protection against dusts.

However, since the width of a woven fabric that can be conventionally manufactured is inevitably limited to the width of a weaving loom used, the width of a unit fabric is not more than about 2.5 m at the maximum. Therefore, a woven fabric having a large area, such as those mentioned above, cannot be manufactured by any means other than piecing together a plurality of unit fabrics. FIG. 4 is a perspective view showing an example of the conventional extra-broad woven fabric. As shown, (1*a*) indicates a unit fabric and (1*b*) indicates a seam jointing the adjacent unit fabrics.

Although an extra-broad woven fabric can thus be provided by sewing together a necessary number of unit fabrics, such production technology calls for much labor and time and the homogeneity of the woven texture is sacrificed by the presence of seams.

The object of the invention is, therefore, to provide a technology by which an extra-broad woven fabric can be manufactured by utilizing an ordinary-size loom.

SUMMARY OF THE INVENTION

The present method of manufacturing an extra-broad woven fabric comprises disposing a warp as divided into a first group warp yarn, a second group warp yarn . . . an i group warp yarn . . . and an n group warp yarn across the width of a loom, inserting a weft in a zigzag fashion turning back at each side of the loom for each group in succession from the first group warp yarn to the n group warp yarn and, then, in the reverse order from the n group warp yarn to the first group warp yarn to complete one cycle of weft insertion and repeating the same cycle time and again.

DETAILED DESCRIPTION OF THE INVENTION

Figure 1:
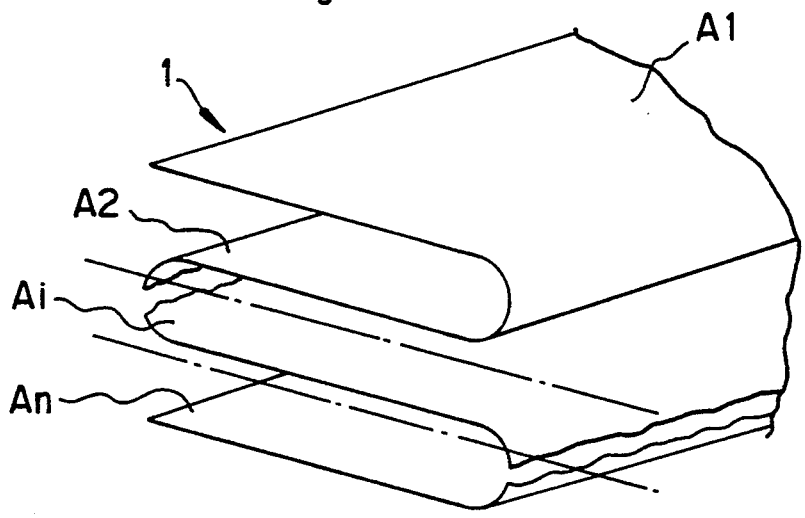
FIG. 1 is a perspective view showing an extra-broad woven fabric according to the invention.

FIG. 1 is a perspective view showing an extra-broad woven fabric according to the invention.

To begin with, in accordance with the invention, a warp yarn (H) for setting up on a weaving loom through the harnesses thereof is distributed into n groups across the width of the loom. Thus, the warp (H) is disposed in the following n rows:

A row of first group warp (H1)
A row of second group warp (H2)
A row of i group warp (Hi)
A row of n group warp (Hn)

In this arrangement, the assembly of first group warp (H1) is used for the weaving of a first unit web (A1), the assembly of second group warp (H2) for a second unit web (A2), the assembly of i group warp (Hi) for an i unit web, and the assembly of n group warp (Hn) for an n unit web.

After completion of the above preparatory work, all the first group warp yarns (H1) are shedded for weft inserting and the warp yarns in the other groups are retained in the standby condition (step 1 of FIG. 5(*a*)). The standby position here means the condition in which the relevant warp yarns are not allowed to participate in weaving by weft insertion.

The weft (L) is then inserted in the above arrangement and, then, at the beginning of return path of the weft (L), the second group warp (H2) is shedded and weft insertion through the resulting sheds is performed (step 2 of FIG. 5(*b*)). During this operation, too, the warp yarns (H) in the other groups are all retained in the standby condition.

This weft inserting operation using the same weft yarn is repeated in a zigzag fashion until the n group warp (Hn) has been involved in weaving (steps 3–4 in FIGS. 5(*c*) and 5(*d*)) and, then, further continued in the reverse order until the first group warp (H1) has been dealt with to complete one cycle of weft insertion (steps 5–8 in FIGS. 5(*e*)–5(*h*)).

An extra-broad woven fabric, such as one shown in FIG. 1, can be manufactured by repeating the above cycle.

According to the mode of weft (L) pairing and the manner of vertical motion of the harnesses, a variety of constructions such as plain weave, twill, satin weave, etc. can be adopted.

As the warp and weft yarns for the manufacture of the extra-broad woven fabric of the invention, there can be employed yarns made of a diversity of fiber materials such as polyester fiber, polyamide fiber (inclusive of aramid fiber), acrylic fiber, polyvinyl alcohol fiber, polyvinyl chloride fiber, polyvinylidene chloride fiber, polyvinyl chloride fiber, polyolefin fiber, polyurethane fiber, fluororesin fiber, semi-synthetic fiber, regenerated fiber, carbon fiber, glass fiber, ceramic fiber and metal fiber.

In the manufacture of an extra-broad woven fabric in accordance with the invention, designing of the vertical motion of each harness is first carried out. In this design, the harness motion must be coordinated in time with weft (L) insertion.

Thus, for weft insertion for the first group warp (H1), the harnesses carrying the first group warp yarns (H1) are opened and the weft (L) is inserted into the resulting sheds as shown in FIG. 5(*a*). On completion of this operation, the harnesses are shifted vertically and the reed is driven for beating to effect weaving. During this operation, the warp yarns (H) in the other groups are retained in the standby position and, thus, precluded from participating in weft insertion.

Therefore, while the first group warp (H1) is subjected to weft insertion, it is kept apart from the warp yarns (H) in other other groups so that only the first unit web (A1) is woven.

For the second group warp (H2), the corresponding harnesses only are opened and shifted vertically in the same manner as above, with the other harnesses being held in the standby position as shown in FIG. 5(*b*). In this case, the same weft (L) used for the first group warp is turned back and used for weft insertion, with the result that the first group warp (H1) and the second group warp (H2) are interconnected only at the turning point. In this condition, the second unit web is woven.

Thus, the resulting extra-broad woven fabric consists of said first unit web (A1), second unit web (A2) . . . i unit web (Ai) . . . and n unit web (An) as interconnected only at the weft turning points of the loom.

The above design of harness and weft motions can be previously encoded in a punched card and supplied as a program input to the loom to operate the machine as designed.

In accordance with the present invention, even with a weaving loom of limited width, the weft yarn (L) can be shuttled in a zigzag fashion to weave an extra-broad fabric having a width corresponding to n times the machine width, thus dispensing with the need to piece together a plurality of unit fabrics and contributing a great deal to improved productivity and product quality.

The preferred embodiment of the invention is now described with reference to the accompanying drawings.

Figure 2A:
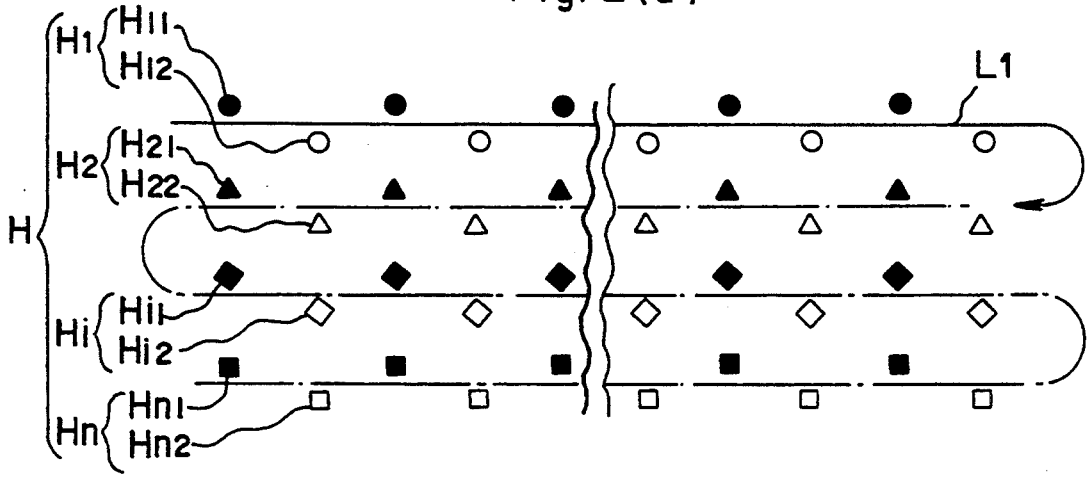
FIGS. 2 and 3 are schematic diagram illustrating the method for manufacture of an extra-broad woven fabric of the invention.
Figure 2B:
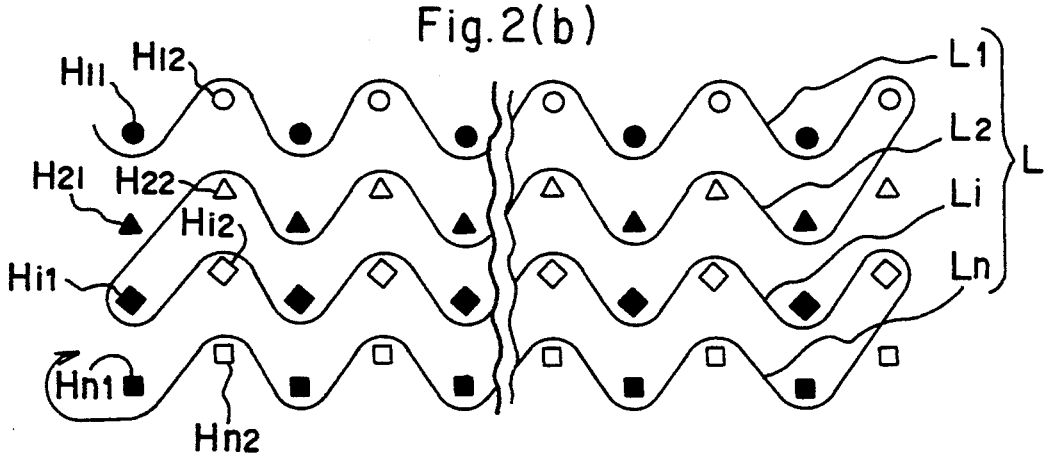
Figure 3:
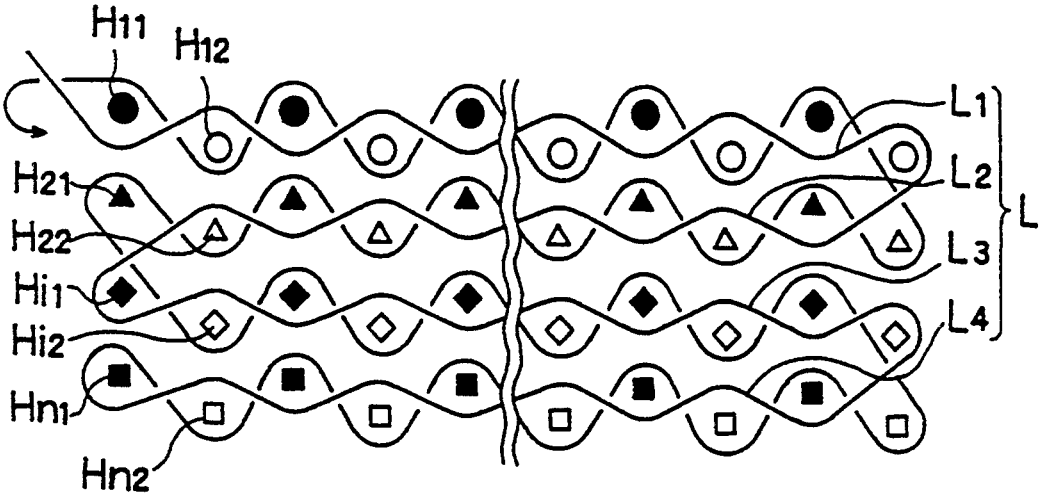
Figure 4:
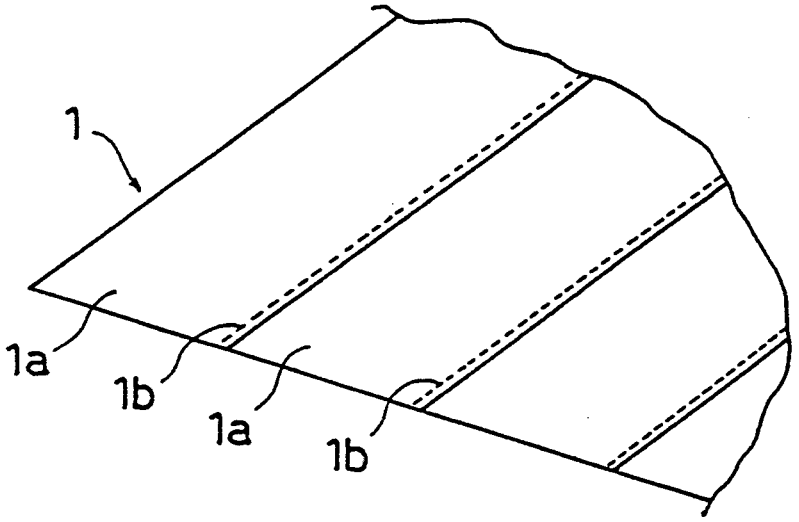
Fig. 4 PRIOR ART
FIG. 4 is a perspective view showing an example of the conventional extra-broad woven fabric.
Figures 5A, 5B, 5C:
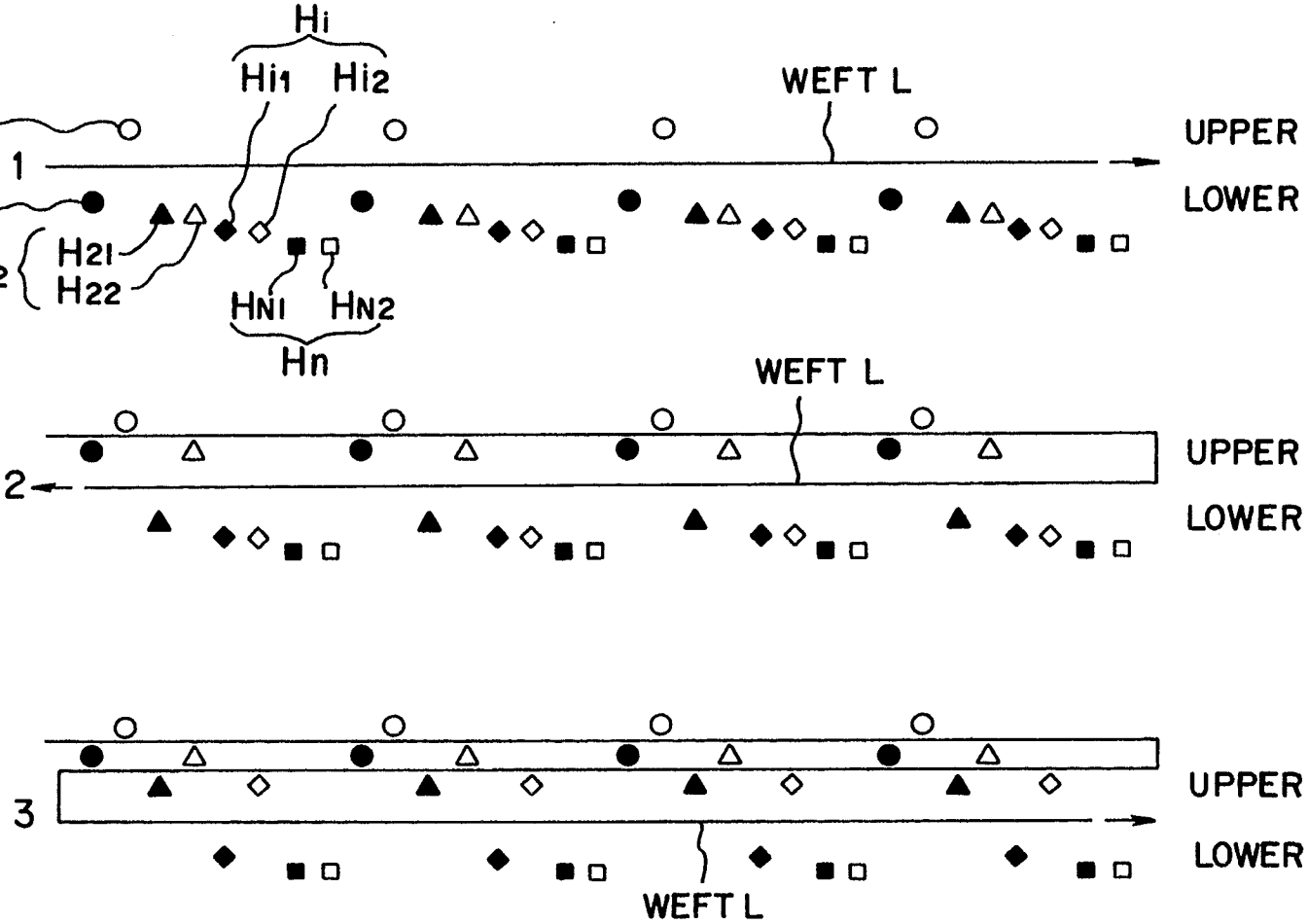
FIGS. 5(*a*)–(*h*) are schematic diagrams illustrating sequential steps for the manufacture of an extra-broad woven fabric of the invention.
Figure 5D:
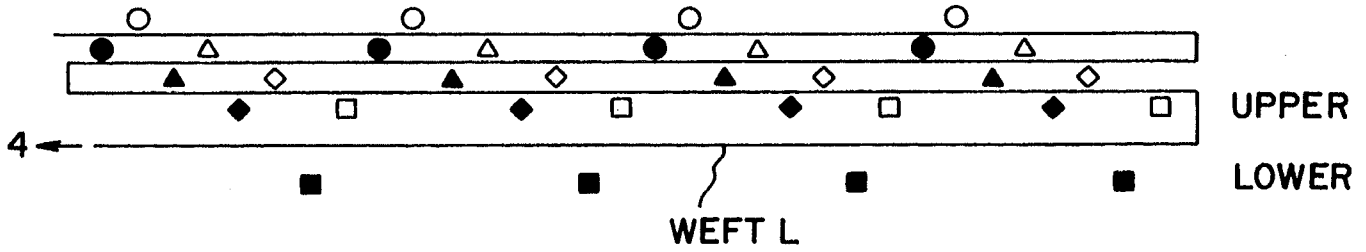
Figure 5E:
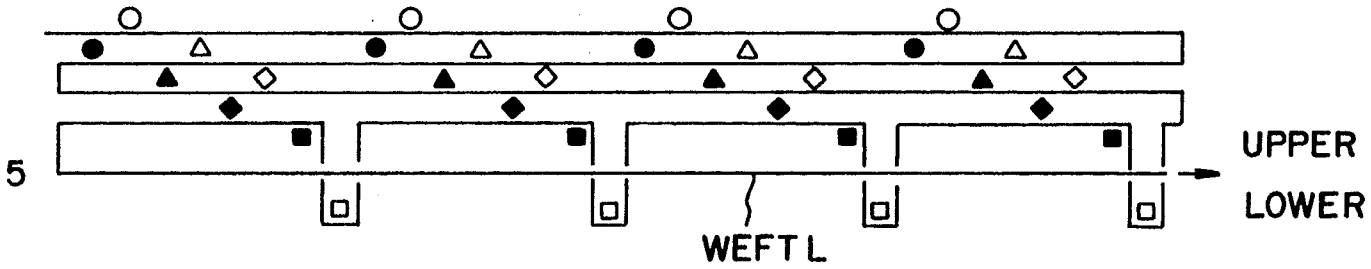
Figure 5F:
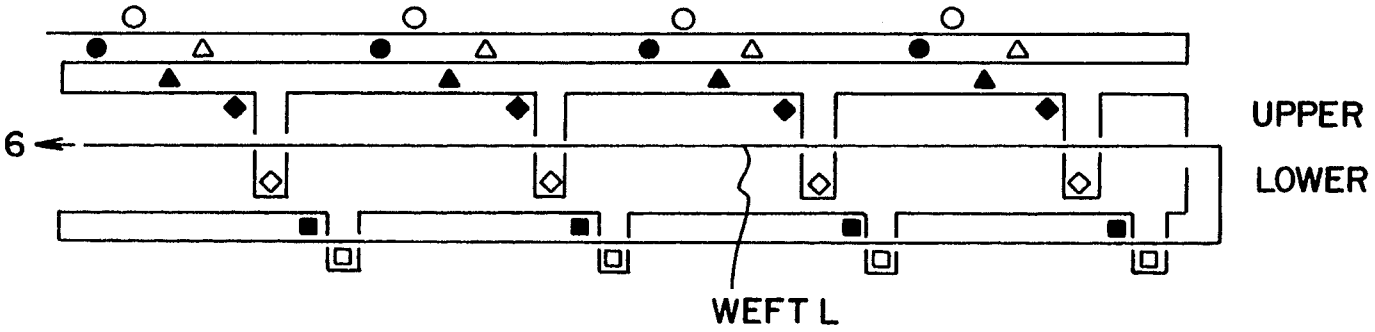
Figure 5G:
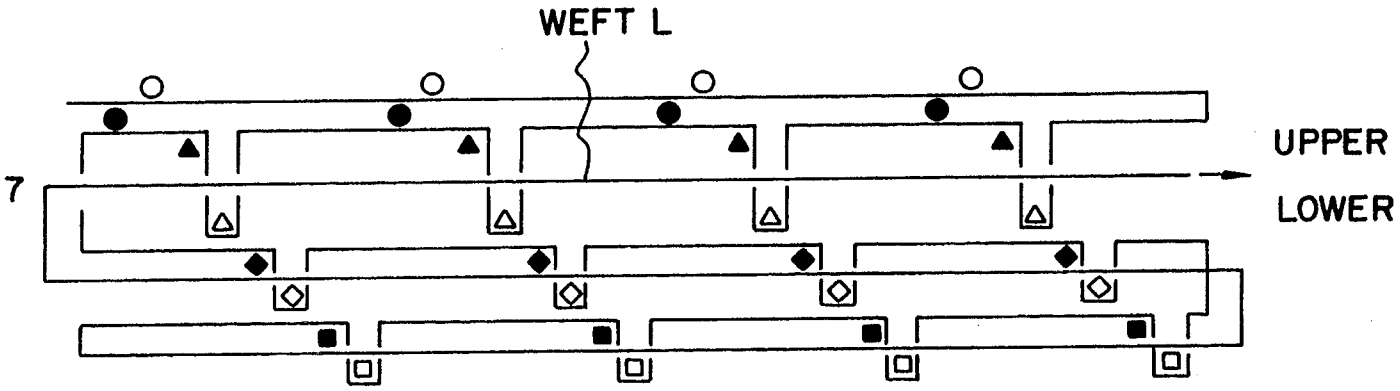
Figure 5H:
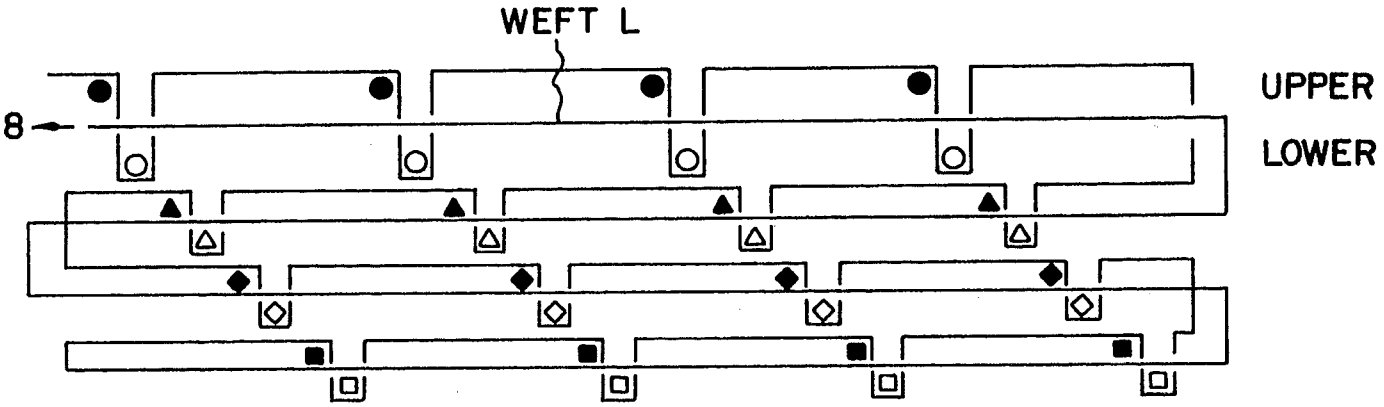

FIGS. 2 and 3 are schematic views showing the manufacture of an extra-broad-width woven fabric according to the present invention. In this embodiment, a warp yarn (H) to be framed up through harnesses are divided into n sets of substantially the same number of warp yarns throughout the loom width. This arrangement is such that the warp (H) is vertically set as divided into a first group warp (H1), a second group warp (H2) . . . , an ith group warp (Hi) . . . , an nth group warp (Hn), and the unit of each i group warp (Hi) is composed of an i group left warp (Hi1) and an i group right warp (Hi2).

Thus, the whole arrangement consists of:

the pair (H11,H12) of the first group warp (H1), the pair (H21,H22) of the second group warp (H2), the pair (Hi1,Hi2) of the ith group warp, the pair (Hn1,Hn2) of the nth group warp (Hn).

The transverse dimension of the above arrangement corresponds to the loom width.

The above arrangement and the motions of the warp (H) and weft (L) are illustrated in FIGS. 2 and 3. The circle represents the first group warp, the triangle represents the second group warp (H2), the diamond represents the ith group warp (Hi) and the square represents the nth group warp (Hn). Each closed mark represents the left yarn of each warp group and each open mark represents the right yarn of each warp group.

There are four conditions of the harness, namely the open condition forming a shed, the vertically moving condition, the condition during which the reed is beating, and the standby condition, and the harness is brought into these conditions sequentially. The vertical motion of the harness is now explained taking the i group warp (Hi) as an example. When the i group left warp (Hi1) is in the raised position and the i group right warp (Hi2) is in the lowered position with respect to the weft (L), the i group left warp (Hi1) is lowered while the i group right warp rises. FIG. 5(*a*) shows this condition. initial relation is reverse, the reverse of the above motion takes place. FIG. 5(*b*) shows this condition.

In the standby condition, the i group warp (Hi) (both the i group left warp and the i group right warp) stands by in the position where it does not participate in picking or weft insertion. The warp (H) in this condition is not woven.

In the present invention, the weft (L) is first thrown into the shed formed between the first group left warp (H11) and right warp (H12) of the first group warp as illustrated in FIG. 2 (*a*). Upon completion of picking, the harness for the first group warp (H1) undergoes a vertical motion to reverse the vertical relation of said first left warp (H11) and right warp (H12) of the first group warp (H1) and the first group weft (L1) and the first group warp (H1) are interwoven. Beating by the reed ensues and, thereafter, the weft (L) is turned back and inserted into the shed between the second group left warp (H21) and second group right warp (H22) of the second group warp (H2), followed by vertical motion of the second group warp (H2) and beating. This sequence is repeated for the i group left warp (Hi1) and i group right warp (Hi2) until finally the above picking, vertical motion and beating have been completed for the n group left warp (Hn1) and n group right warp (Hn2).

The condition after completion of said vertical motion is illustrated in FIG. 2(*b*).

The above actions are now re-commenced from the n group warp (Hn) towards the first group warp (H1).

When the weft (L) has returned to the starting point of the first picking, one cycle of weft insertion is completed. The condition at completion of one cycle is illustrated in FIG. 3. The movement of weft (L) is a zigzag movement from one side of the loom to the other side.

As to the weave construction, plain weave was employed in this example to obtain an extra-broad woven fabric consisting of n consecutive unit webs each having a width substantially equal to the loom width.

The present invention is now described in further detail from operation points of view.

In weaving, the warp (H) is first divided into a plurality of stages and passed through the mails (eyes) of harnesses so that sheds may be formed at one time for each group, independently of others.

The vertical motion of the harnesses is set to take place sequentially beginning with the harness for the first group warp (H1) and progressing to those for the second group (H2), ith group (Hi) and nth group (Hn) warps and, then, back to the n group warp (Hn) to the first group warp (H1) and in timed relation with this motion, the weft (L) is inserted into the sheds formed by the i group warp (Hi). In this operation, the warp yarns (H) of the groups not participating in weft insertion are retained in the standby position.

The above vertical motion of harnesses and weft insertion are performed according to a punched card program previously supplied to the loom.

In this manner, the weft (L) shuttled into the shed formed by the left warp yarn (H11) and right warp yarn (H12) of said first group warp (H1) is a first group warp (L1) which forms a first unit web (A1).

Similarly the weft (L) inserted shuttled into the shed formed by the second group warp (H2) is a second group weft (L2) which forms a second unit web (A2). The weft (L) constituting an ith group weft (Li) for the i group warp (Hi) forms an ith unit web (Ai), and the weft (L) constituting an n group weft (Ln) forms the nth unit web (An).

As the above-described reciprocating zigzag motion of weft (L) across the whole loom width is repeated, the first unit web (A1), the second unit web (A2) . . . ith unit web (Ai) . . . and nth unit web (An) are woven but since the entire fabric is woven by the reciprocation of a single weft yarn, the respective i unit fabrics are interconnected at their turning points so that when the final fabric is spread, its width is as great as the width of each unit fabric multiplied by n.

What is claimed is:

1. A method of manufacturing an extra-broad or wide woven fabric comprising arranging warp yarns into a first group warp yarn, a second group warp yarn . . . an ith group warp yarn . . . and an nth group warp yarn across the width of a weaving loom, inserting a weft in a zigzag fashion turning back at each loom side for each group in succession from the first group warp yarn to the nth group warp yarn and, then, inserting the weft in the reverse order from the nth group warp yarn to the first group warp yarn to complete one cycle of weft insertion and repeating the same cycle to obtain an extra-broad or wide woven fabric.

* * * * *